US008354981B2

(12) United States Patent
Kawasaki et al.

(10) Patent No.: US 8,354,981 B2
(45) Date of Patent: Jan. 15, 2013

(54) ACTIVE MATRIX TYPE DISPLAY APPARATUS AND DRIVING METHOD THEREOF

(75) Inventors: Somei Kawasaki, Saitama (JP); Tatsuhito Goden, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 982 days.

(21) Appl. No.: 12/164,542

(22) Filed: Jun. 30, 2008

(65) Prior Publication Data

US 2009/0015571 A1 Jan. 15, 2009

(30) Foreign Application Priority Data

Jul. 2, 2007 (JP) ..... 2007-174121

(51) Int. Cl.
*G09G 3/30* (2006.01)

(52) U.S. Cl. ..... 345/77

(58) Field of Classification Search ..... 345/204, 345/76, 77

See application file for complete search history.

(56) References Cited

U.S. PATENT DOCUMENTS

| | | | | |
|---|---|---|---|---|
| 5,302,871 | A | 4/1994 | Matsuzaki et al. | |
| 5,963,184 | A | 10/1999 | Tokunaga et al. | |
| 6,188,378 | B1 | 2/2001 | Yamamoto et al. | |
| 6,335,720 | B1 | 1/2002 | Mori et al. | |
| 6,348,910 | B1 | 2/2002 | Yamamoto et al. | |
| 6,373,454 | B1 | 4/2002 | Knapp et al. | 345/76 |
| 6,552,709 | B1 | 4/2003 | Yamaguchi | |
| 6,559,824 | B1 | 5/2003 | Kubota et al. | |
| 6,587,086 | B1 | 7/2003 | Koyama | |
| 6,661,180 | B2 | 12/2003 | Koyama | 315/169.3 |
| 7,126,565 | B2 | 10/2006 | Kawasaki et al. | |
| 7,242,397 | B2 | 7/2007 | Iseki et al. | 345/204 |
| 7,253,812 | B2 | 8/2007 | Sasaki | |
| 7,259,735 | B2 | 8/2007 | Kasai | |
| 7,532,207 | B2 | 5/2009 | Kawasaki et al. | |
| 7,605,899 | B2 | 10/2009 | Shikina et al. | |
| 7,692,643 | B2 | 4/2010 | Kawasaki et al. | |
| 7,812,812 | B2 | 10/2010 | Yoshinaga et al. | |
| 7,911,425 | B2 | 3/2011 | Goden et al. | |
| 2002/0047581 | A1 | 4/2002 | Koyama | |

(Continued)

FOREIGN PATENT DOCUMENTS

CN 1521719 A 8/2005

(Continued)

*Primary Examiner* — Amr Awad
*Assistant Examiner* — Randal Willis
(74) *Attorney, Agent, or Firm* — Fitzpatrick, Cella, Harper & Scinto

(57) ABSTRACT

In an active matrix type display apparatus, during a first selection period, a second main conductive terminal of a drive transistor and a display element are isolated, and at the same time, a control terminal of the drive transistor and the second main conductive terminal and a signal line are connected, and the signal line is supplied with a first current capable of conducting the drive transistor. The first current does not correspond to a signal current corresponding to a current injected to the display element. During a second selection period, a connection of the second main conductive terminal of the drive transistor and the signal line is broken, and the signal line is supplied with a second current. The second current corresponds to a signal current corresponding to the current injected to the display element. During a non-selection period, the second main conductive terminal of the drive transistor and the display element are connected, and the drive current of the drive transistor corresponding to voltage between both terminals of a capacitive element is supplied to the display element.

8 Claims, 8 Drawing Sheets

U.S. PATENT DOCUMENTS

| | | | | |
|---|---|---|---|---|
| 2003/0058687 | A1* | 3/2003 | Kimura | 365/177 |
| 2004/0155843 | A1 | 8/2004 | Sasaki | |
| 2004/0183752 | A1 | 9/2004 | Kawasaki et al. | |
| 2005/0007316 | A1 | 1/2005 | Akimoto et al. | |
| 2005/0007319 | A1 | 1/2005 | Shin et al. | |
| 2005/0041002 | A1 | 2/2005 | Takahara et al. | |
| 2005/0122150 | A1 | 6/2005 | Iseki et al. | 327/215 |
| 2005/0285151 | A1 | 12/2005 | Kawasaki | 257/213 |
| 2006/0061529 | A1 | 3/2006 | Kim | |
| 2006/0114194 | A1 | 6/2006 | Kawasaki et al. | 345/76 |
| 2006/0114195 | A1 | 6/2006 | Yamashita et al. | |
| 2006/0132395 | A1 | 6/2006 | Kawasaki et al. | 345/75.2 |
| 2006/0187185 | A1 | 8/2006 | Yoshinaga et al. | 345/107 |
| 2006/0267509 | A1 | 11/2006 | Yang | |
| 2007/0132719 | A1 | 6/2007 | Yamashita et al. | 345/156 |
| 2007/0257867 | A1 | 11/2007 | Kasai | |
| 2007/0257868 | A1 | 11/2007 | Kasai | |
| 2008/0007494 | A1 | 1/2008 | Kim et al. | |
| 2008/0157828 | A1 | 7/2008 | Kawasaki et al. | 327/108 |
| 2008/0158112 | A1 | 7/2008 | Kawasaki et al. | 345/76 |
| 2008/0259000 | A1 | 10/2008 | Kawasaki | |
| 2009/0015571 | A1 | 1/2009 | Kawasaki et al. | |
| 2009/0033599 | A1 | 2/2009 | Kawasaki et al. | |
| 2009/0066615 | A1 | 3/2009 | Kawasaki | |
| 2009/0085908 | A1 | 4/2009 | Kawasaki et al. | |
| 2009/0102853 | A1 | 4/2009 | Kawasaki et al. | |
| 2009/0109144 | A1 | 4/2009 | Goden et al. | |
| 2009/0121980 | A1 | 5/2009 | Kawasaki et al. | |
| 2009/0135110 | A1 | 5/2009 | Nakamura et al. | |
| 2009/0231239 | A1 | 9/2009 | Goden et al. | |
| 2009/0289966 | A1 | 11/2009 | Ikeda et al. | |
| 2010/0026677 | A1 | 2/2010 | Shikina et al. | |
| 2010/0073267 | A1 | 3/2010 | Akimoto et al. | |
| 2010/0128160 | A1 | 5/2010 | Maru et al. | |
| 2010/0328365 | A1 | 12/2010 | Ikeda et al. | |
| 2011/0025653 | A1 | 2/2011 | Ikeda et al. | |
| 2011/0090210 | A1* | 4/2011 | Sasaki et al. | 345/211 |

FOREIGN PATENT DOCUMENTS

| | | | |
|---|---|---|---|
| CN | 1770246 | A | 5/2006 |
| EP | 1 429 312 | A2 | 6/2004 |
| JP | 11-282417 | A | 10/1999 |
| JP | 2001-134229 | A | 5/2001 |
| JP | 2001-159877 | A | 6/2001 |
| JP | 2004-3411144 | A | 12/2004 |
| JP | 2005-157322 | | 6/2005 |
| JP | 2006-030516 | A | 2/2006 |
| JP | 2008-268981 | A | 11/2008 |
| JP | 2008-015516 | A | 12/2008 |

* cited by examiner

ACTIVE MATRIX TYPE DISPLAY APPARATUS AND DRIVING METHOD THEREOF

BACKGROUND OF THE INVENTION

1. Field of the Invention

The present invention relates to an active matrix type display apparatus using a display element, specifically, an electroluminescent element (hereinafter, referred to as an EL element) to emit light by injecting a current for displaying an image an image display and the driving method thereof. Hereinafter, in the present specification, the active matrix type display apparatus using the EL element is referred to as an EL panel.

2. Description of the Related Art

<Active Matrix Type Display Apparatus>

FIG. 8 shows a whole configuration example of a color EL panel. The color EL panel shown in the figure includes a display region 2 disposed with a pixel circuit 1 including a display element (an EL element) and a driving circuit thereof as well as a column control circuit 3, a column register 5, a row register 6 and a control circuit 9.

The display region 2 is disposed with a plurality of pixel circuits 1 in a matrix shape along row and column directions. Each pixel circuit 1 is connected with a signal line 4 and a scanning line 7 of the corresponding column. The pixel circuit 1 of the column is loaded with a display signal supplied simultaneously to the corresponding signal line 4 (row selection period) by a control signal (scanning signal) of the scanning line 7. When the scanning signal moves to the next row, the display element contained in each pixel circuit 1 is lighted up in luminance corresponding to the loaded display signal (lighting period). The pixel circuit 1, to perform a color display, includes three sets having a display element of RGB primary colors.

The scanning signal of each scanning line 7 is generated by a row clock KR and a row register 6 having register blocks as many as rows input with a column scanning start signal SPR. The display signal of each column supplied to each signal line 4 is generated by the column control circuits 3 as many as columns. Corresponding to the display element of RGB primary colors disposed for every three columns, the column control circuit 3 includes three sets of the display element. In the column control circuit 3 of each column, a desired display signal is supplied to the signal line 4 of each column by a video signal VIDEO and a sampling signal SP as well as a horizontal control signal 8. A control circuit 9 is input with a horizontal synchronization signal SC corresponding to the video signal VIDEO 9, and generates a horizontal control signal 8. The sampling signal SP is generated by the column resister 5 made of ⅓ number of registers of the column control circuit 3. The column resistor 5 is input with a column clock KC and a column scanning start signal SPC, and the horizontal control signal 8 for mainly performing a reset operation of the column register 5.

<Pixel Circuit>

For the pixel circuit 1, a current writing type endurable to the characteristic variations of a TFT (a thin film transistor) element being used is commonly employed. In this case, a display signal supplied to the signal line 4 is a current signal. The pixel circuit 1 of the display panel is usually formed of the TFT. Since the TFT is great in the characteristic variations, the current writing type endurable to the characteristic variations is often used.

FIGS. 9 and 10 are configuration examples of the pixel circuit of the current writing type (referred to also as [current programming system]) disclosed in each of U.S. Pat. Nos. 6,373,454 and 6,661,180. The pixel circuit 1 shown in the figures includes the EL element (EL in the figures) which is the display element and the drive circuit of the EL element. The drive circuit, in the example of the figures, contains switching transistors (hereinafter, referred to as transistor) M1, M2 and M4 made of an n-type TFT, a drive transistor M3 made of a p-type TFT, and a capacitive element (capacitor) C1.

The pixel circuit 1 is connected with a emission power line PVdd, a signal line "data" for supplying a current "Idata", and scanning lines P1 and P2 (a first scanning line and a second scanning line) for supplying scanning signals, and a current writing operation and a lighting operation are performed through the driving circuit of the EL element. The EL element has an anode terminal (a current injection terminal) connected to the emission power line PVdd (a first power source) through the transistor M4 and the drive transistor M3, and has the cathode terminal connected to a grounding line (a second power source) CGND.

FIG. 11 shows a time chart of each scanning signal of the scanning lines P1 and P2.

First, at the current writing operation time (row selection time T1), each scanning signal becomes P1=H level and P2=L level, and the transistors M1 and M2 are turned on, and the transistor M4 is turned off. Then, the drive transistor M3 has a drain terminal isolated from a current injection terminal (anode terminal in the examples of FIGS. 9 and 10) of the EL element. In this state, the drive transistor M3 has a gate terminal connected to the signal line "data", and at the same time, has the gate terminal and the drain terminal short-circuited, thereby being put into a diode connection state. As a result, by the current "Idata" supplied to the signal line "data", the gate voltage decided by the characteristic of the drive transistor M3 is generated, and is charged to a capacitive element C1 between the gate terminal and the source terminal.

Next, at the lighting operation time (lighting period T2), each scanning signal becomes P1=L level and P2=H level, and the transistors M1 and M2 are turned off, and the transistor M4 is turned on. Then, the drive transistor M3 has a drain terminal connected to a current injection terminal (an anode terminal in the examples of FIGS. 9 and 10) of the El element. In this state, the drive transistor M3 has a gate terminal isolated from the signal line "data", and is put into an open state, and therefore, at the current writing operation time, the voltage charged to the capacitive element C1 between the gate terminal and the source terminal becomes a gate voltage of the transistor M3 as it is. As a result, the current flowing through the drive transistor M3 becomes approximately the current "Idata" of the signal line "data", and therefore, the EL element can light up by emission brightness according to the current "Idata".

When the pixel circuit shown in FIG. 9 is actually formed on the substrate as a display panel, as shown in FIG. 12, each pixel circuit is accompanied by parasitic capacitances cx1 and cx4 respectively by a wire crossing of the scanning lines P1 and P2 and the signal line "data". Further, for a high-definition display panel, a top emission system that takes out light from above the pixel circuit is commonly adopted. For this reason, the signal line "data", in the regions superposed with the anode electrode of the EL element and not superposed with the anode electrode, is superposed with a cathode transparent electrode deposited on the whole display region, and thus, parasitic capacitances cx2 and cx3 are accompanied, respectively. Other than these parasitic capacitances, the signal line "data" is accompanied by a capacitance cx5 between a control terminal (a gate terminal) and a main conductive terminal (a source or a drain terminal) of the transistor M2.

The parasitic capacitance accompanying the signal line "data" of each column becomes a total sum of the parasitic capacitance accompanying the pixel circuit of each column. The parasitic capacitance value accompanying this signal line depends on a panel size and the number of displays. For example, in the display panel of 3 inches by 480 rows, the parasitic capacitance value becomes approximately 5 pF. In the pixel circuit of FIG. 10 also, the parasitic capacitance accompanying this signal line becomes approximately the same.

However, the current writing operations of the pixel circuits shown in FIGS. 9 and 10 are greatly affected by the parasitic capacitance. A current writing operating ability (PRG ability) is approximately shown in the following formula (1).

$$[PRG\text{ ability}]=[\text{writing current}]\times[\text{writing time}]+[\text{signal line parasitic capacitance}] \quad (1).$$

Unless this [PRG ability] value is secured, a normal current writing operation cannot be realized due to the characteristic variation of the TFT element in which the pixel circuit is generally formed. For that reason, a display image quality is remarkably deteriorated. Particularly, the display image quality of a low brightness small in writing current is deteriorated, and at the same time, a contrast ratio which is an important factor of the image quality cannot be increased. To increase the [PRG ability], the [signal line parasitic capacitance] is almost decided by the number of display rows and a display size, and a substantial reduction cannot be expected, and at the same time, the [writing time] also cannot be increased because of the maintenance of a refresh rate of the display image.

Further, in the pixel circuits shown in FIGS. 4 and 5, the writing current and the drive current are approximately the same. The drive current injected to the EL element cannot be increased when not controlled during the emission period by the scan line P2 to decide the display image, and therefore, the writing current also cannot be increased. Even when controlled during the emission period, an instantaneous light amount of the EL element is increased, and therefore, the writing current cannot be increased when taking into consideration brightness degradation which is a major problem of the EL element.

SUMMARY OF THE INVENTION

An object of the present invention is to solve such a problem and provide a pixel circuit capable of improving a current writing ability in a low drive current (low brightness) region of a current writing type pixel circuit.

To achieve the object, the active matrix type display apparatus according to the present invention is an active matrix type display apparatus configured by disposing a pixel circuit for supplying the current to a display element disposed at a position where a signal line and a scanning line are intersected, the pixel circuit including: a drive transistor having a first main conductive terminal connected to a constant voltage source, a second main conductive terminal for injecting the current to the display element, and a control terminal; and a capacitive element connected between the control terminal of the drive transistor and the first main conductive terminal, the pixel circuit being connected to the signal line during a selection period, and isolated from the signal line during a non-selection period, wherein the selection period includes a first period and a second period, and during the first period, the second main conductive terminal of the drive transistor and the display element are isolated, the control terminal and the second main conductive terminal of the drive transistor are connected to the signal line, and the signal line is supplied with the constant current capable of conducting the drive transistor, during the second period, the second main conductive terminal of the drive transistor is disconnected from the signal line, and the signal line is supplied with a signal current corresponding to the current injected to the display element, and during the non-selection period, the second main conductive terminal of the drive transistor and the display element are connected, and a drive current according to the voltage between both terminals of the capacitive element is supplied from the drive transistor to the display element.

In the present invention, during a predetermined period before transiting from the first period to the second period, the control terminal of the drive transistor may be disconnected from the signal line. During the predetermined period within the non-selection period, a connection with the second main conductive terminal of the drive transistor and the display element may be broken so as to perform a lighting-turning-off control.

The pixel circuit may further include a first switch, a second switch and a third switch including the transistors whose on-and-off operations are controlled by the control signal of the scanning line, and the first switch may be disposed between the control terminal of the drive transistor and the signal line, and the second switch may be disposed between the second main conductive terminal of the drive transistor and the signal line, and the third switch may be disposed between the second main conductive terminal of the drive transistor and one terminal of the display element.

The scanning line includes a first scanning line, a second scanning line and a third scanning line, the first scanning line may be connected to a control terminal of the first switch, the second scanning line may be connected to a control terminal of the second switch, and the third scanning line may be connected to a control terminal of the third switch.

The scanning line may include a first scanning line and a second scanning line, the second switch may include two second switches mutually connected in series, the third switch may include two third switches mutually connected in series, the first scanning line may be connected to each control terminal of the first switch, one of the two second switches, and one of the two third switches, and the second scanning line may be connected to each control terminal of the other of the two second switches and the other of the two third switches.

Any of the drive transistor, the first switch, the second switch and the third switch may include a TFT. The drive transistor may include a p-type TFT, and any of the first switch, the second switch and the third switch may include an n-type TFT.

Further, the present invention is a driving method of the active matrix type display apparatus disposed with a pixel circuit to which a signal line and a scanning line are connected for supplying the current to a display element two dimensionally arranged, the pixel circuit including: a drive transistor having a first main conductive terminal connected to a constant voltage source, a second main conductive terminal for injecting the current to the display element, and a control terminal; and a capacitive element connected between the control terminal of the drive transistor and the first main conductive terminal, the pixel circuit being connected to the signal line during a selection period and isolated from the signal line during a non-selection period, wherein the selection period includes a first period and a second period, and during the first period, the second main conductive terminal of the drive transistor and the display element are isolated, the control terminal and the second main conductive terminal of the drive transistor are connected to the signal line, and the signal line is supplied with a constant current capable of conducting the drive transistor, and during the second period, the second main conductive terminal of the drive transistor is disconnected from the signal line, and the signal line is supplied with a signal current corresponding to the current injected to the display element, and during the non-selection period, the second main conductive terminal of the drive transistor and the display element are connected, and a drive current according to the voltage between both terminals of the capacitive element is supplied from the drive transistor to the display element.

According to the present invention, a pixel circuit for improving the current writing ability in the low driving current (low brightness) region of the current writing type pixel circuit can be provided.

Further features of the present invention will become apparent from the following description of exemplary embodiments with reference to the attached drawings.

DESCRIPTION OF THE EMBODIMENTS

Hereinafter, embodiments of the present invention will be described with reference to the accompanied drawings.

[First Embodiment]

First, with reference to FIGS. 1 to 3, a first embodiment of the present invention will be described.

Figure 1:
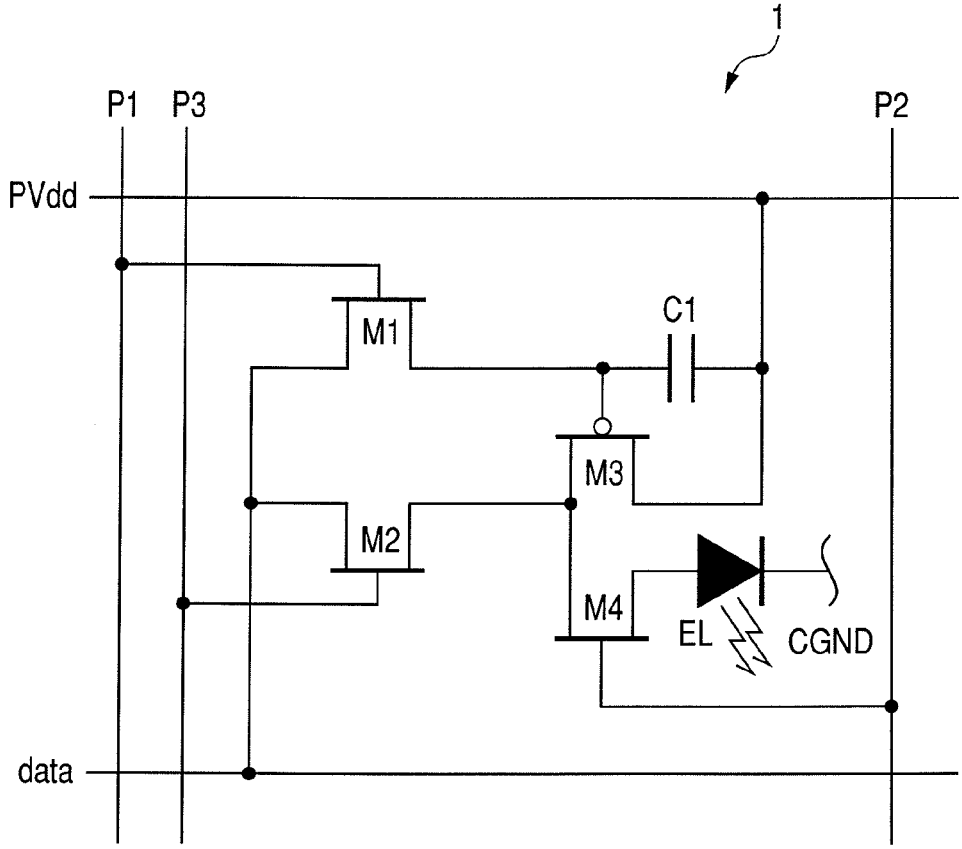
FIG. 1 is a circuit diagram showing a configuration of the pixel circuit of an EL panel according to a first embodiment of the present invention.
Figure 8:
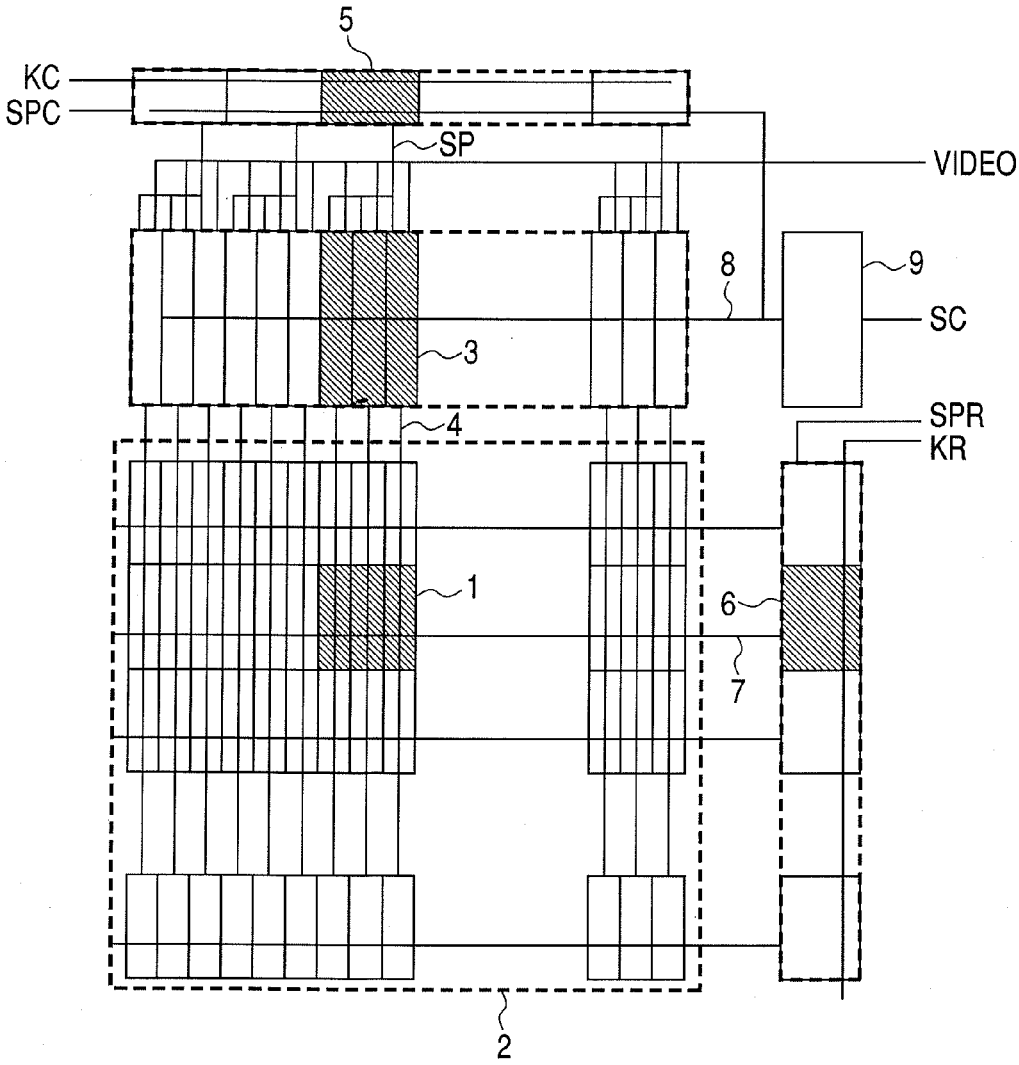
(PRIOR ART) FIG. 8
FIG. 8 is a whole conceptual illustration of a color EL panel.
Figure 10:
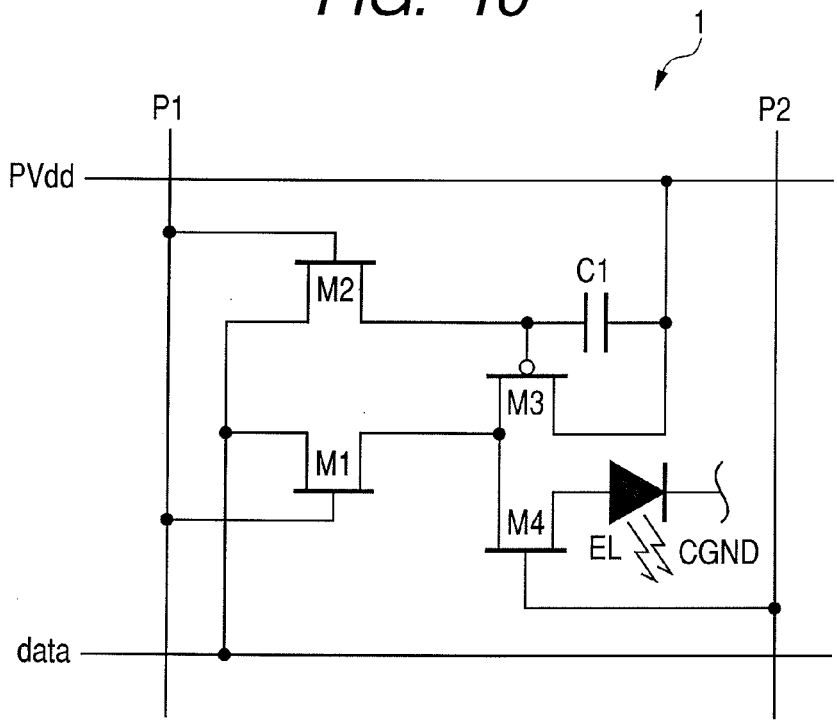
(PRIOR ART) FIG. 10
FIG. 10 is a circuit diagram showing another configuration of the conventional current writing type pixel circuit.
Figure 11:
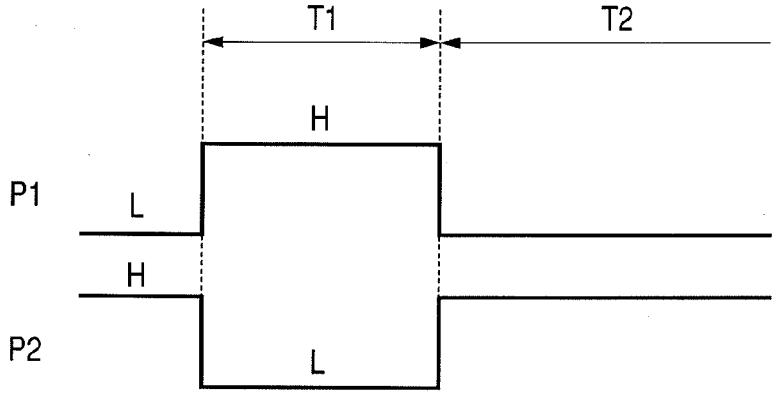
FIG. 11 (PRIOR ART)
FIG. 11 is a time chart for describing the operation of the pixel circuits of FIGS. 9 and 10.

An EL panel (active matrix type display apparatus) according to the present embodiment shown in FIG. 1 uses the current writing type pixel circuit 1 shown in FIG. 10 as the pixel circuit 1 disposed in a display region 2 of the color EL panel shown in FIG. 8. The pixel circuit 1 shown in the figure includes an EL element (referred to also as [OLED: Organic Light Emitting Diode]) which is a display element two-dimensionally disposed and a drive circuit of the EL element.

The drive circuit of FIG. 1, as shown in FIG. 8, is disposed at a position where a scanning line 7 and a signal line 4 are intersected, and includes three switch transistors (hereinafter, referred to as first to third transistors) M1, M2 and M4, and a drive transistor M3 capable of injecting the current to the EL element, and a capacitive element (capacitor or holding capacitance) C1. Any of the first to third transistors M1, M2 and M4 is made of an n-type TFT, and the drive transistor M3 is made of a p-type TFT. The pixel circuit 1 is connected with an emission power source line PVdd, a grounding line CGND, a signal line "data" for supplying a current "Idata", and three scanning lines P1 to P3 for supplying scanning signals for controlling on-off operations of the three transistors M1, M2 and M4.

Figure 12:
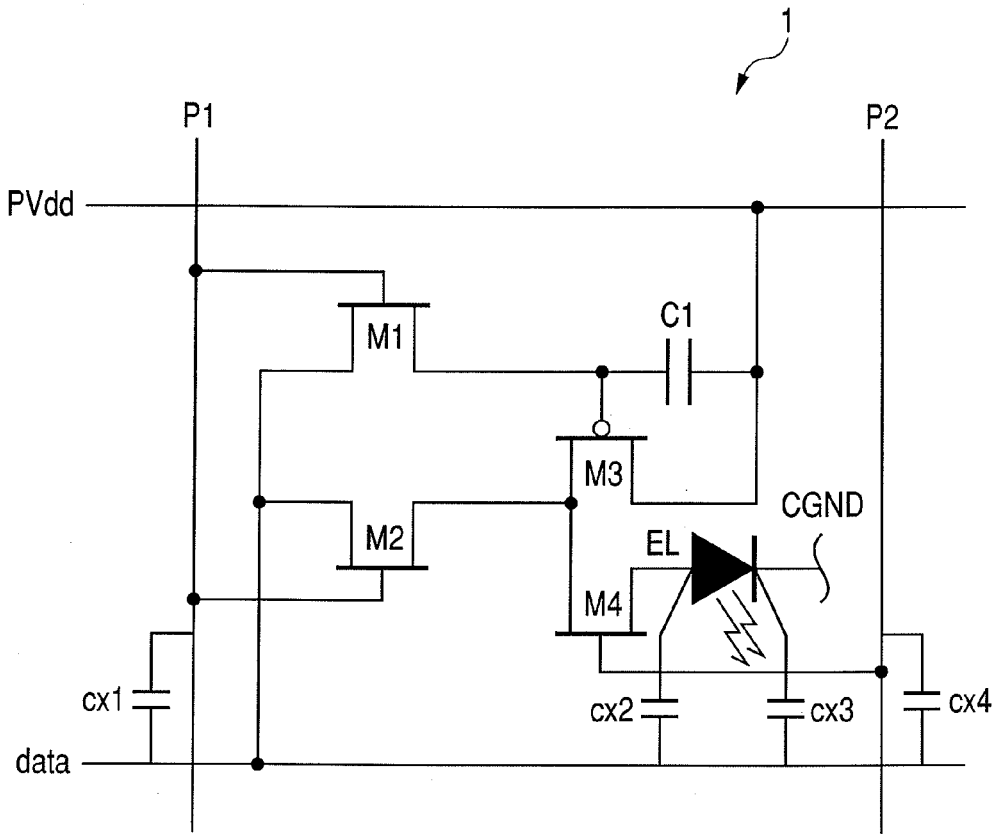
(PRIOR ART) FIG. 12
FIG. 12 is a circuit diagram added with a parasitic capacitance accompanying a signal line of the pixel circuit of FIG. 10.

A circuit configuration of the present embodiment, when compared with FIG. 10, is added with a scanning line P3 (third scanning line), and is different in that the transistor M2 is independently controlled in on-off operations by the scanning signals. Other circuit configurations are the same as FIG. 10 (in the example of the figure, the parasitic capacitance accompanying the signal line "data" shown in FIG. 12 is omitted).

The EL element has an anode terminal (current injection terminal) connected to the emission power line PVdd through the transistor M4 and the drive transistor M3, and has a cathode terminal connected to the grounding line CGND.

A gate terminal (control terminal) of the drive transistor M3 is connected to the signal line "data" through the transistor M1, whereas it is connected to one terminal of the capacitive element C1. A source terminal (first main conductive terminal) of the transistor M3 is connected to the emission power line (constant voltage source) PVdd and the other terminal of the capacitive element C1. A drain terminal (second main conductive terminal) of the drive transistor M3 is connected to the signal line "data" through the transistor M2, while it is connected to the EL element through the transistor M4.

One of the source and drain terminals of the transistor M1 (first switch) is connected to the gate terminal of the drive transistor M3 and one terminal of the capacitive element C1. The other of the source and drain terminals of the transistor M1 is connected to the signal line "data" and one of the source and drain terminals of the transistor M2. A gate terminal of the transistor M1 is connected to the scanning line P1, and is controlled in on-off operations by scanning signals (L and H levels).

One of the source terminal and drain terminal of the transistor M2 (second switch) is connected to the signal line "data" and the other of the source and drain terminals of the transistor M1. The other of the source terminal and drain terminal of the transistor M2 is connected to the drain terminal of the drive transistor M3 and one of the source and drain terminals of the transistor M4. A gate terminal of the transistor M2 is connected to the scanning line P3, and is controlled in on-off operations by the scanning signals (L and H levels).

One of the source and drain terminals of the transistor M4 (third switch) is connected to the drain terminal of the transistor M3 and the other of the source and drain terminals of the transistor M2. The other of the source and drain terminals of the transistor M2 is connected to the anode terminal of the EL element. The gate terminal of the transistor M2 is connected to the scanning line P2, and is controlled in on-off operations by the scanning signals (L and H levels).

Next, the operation of the present embodiment will be described with reference to FIGS. 2 and 3.

Figure 2:
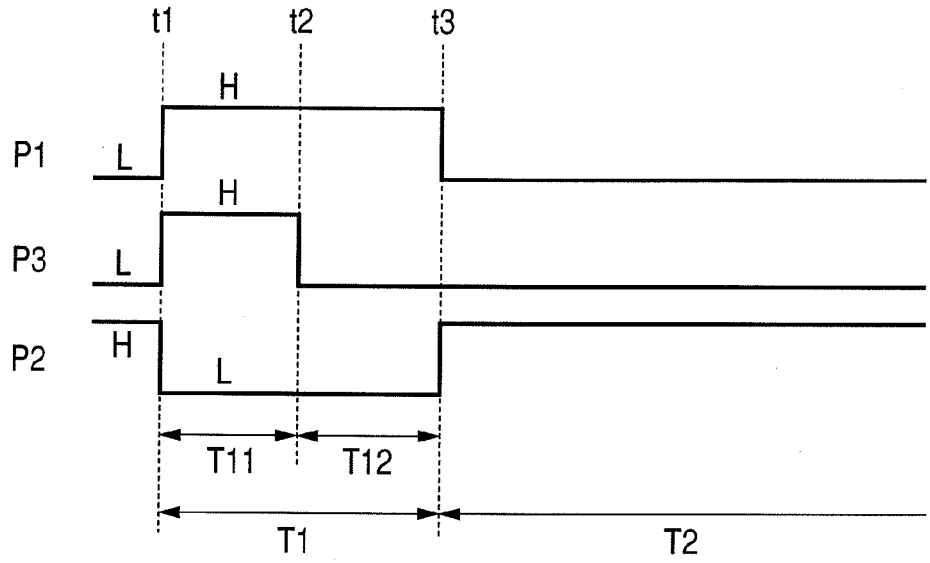
FIG. 2 is a time chart for describing an operation of a first embodiment.

FIG. 2 is a time chart showing each scanning signal of the scanning lines P1, P2 and P3 of the (N)th row. FIG. 3 is a time chart showing a current "Idata" supplied to the signal line "data" across the (N)th row to the (N+2)th row and the gate terminal voltage VG of the drive transistor M3 of the pixel circuit 1.

First, when starting the current writing operation (row selection period T1) of the (N)th row, at the time t1, as shown in FIG. 2, each scanning signal becomes P1=P3=H level and P2=L level, and the transistors M1 and M2 are turned on, and the transistor M4 is turned off. As a result, the pixel circuit 1 of the (N)th row is put into a current writing operation state.

By so doing, the drive transistor M3 has the drain terminal isolated from the anode terminal (current injection terminal) of the EL element through the transistor M4. In this state, the drive transistor M3 has the gate terminal connected to the signal line "data" through the transistor M1, and at the same time, has the gate and drain terminals short-circuited through the transistor M2, and is put into a diode connection state. As a result, by the current "Idata" supplied to the signal line "data", a gate terminal voltage VG decided by the characteristic of the drive transistor M3 is generated, and the gate terminal voltage VG is charged to the capacitive element C1 connected between the gate terminal and the source terminal.

Figure 3:
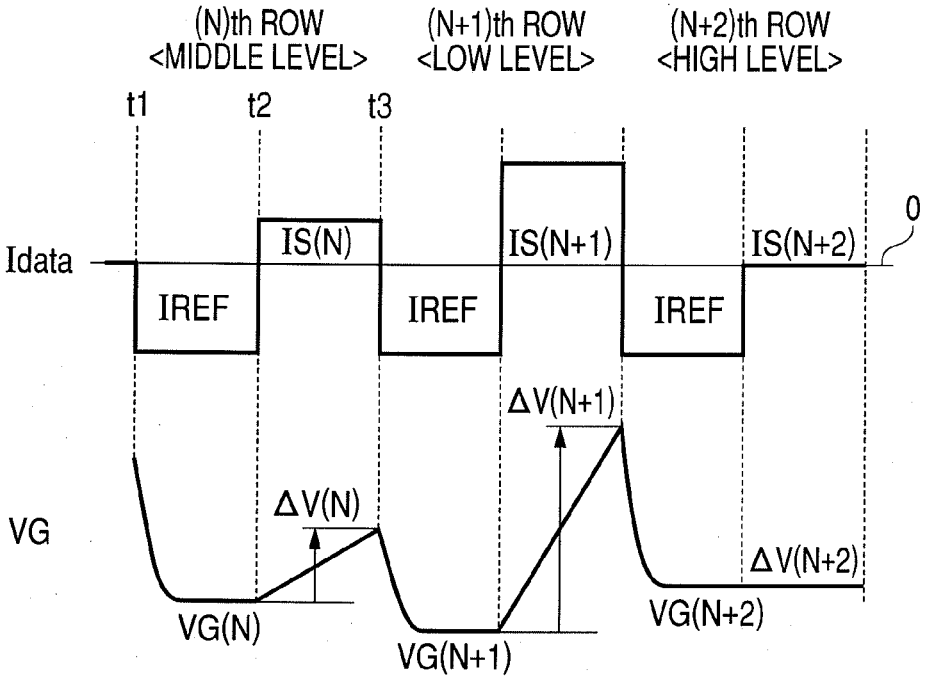
FIG. 3 is a time chart for describing an operation of the first embodiment similarly to FIG. 2.

At this time, as shown in FIG. 3, a current IREF (first current) which is a sink current capable of conducting the drive transistor M3 is supplied to the signal line "data" as the current "Idata" of the signal line "data". Since the current IREF is a current value equal to the drive current necessary for bright display, even when the parasitic capacitance Cs accompanying the signal line "data" is present, it is a current sufficient for the current writing operation. Hence, as shown in FIG. 3, as the convergence of the current writing operation is quick, the gate terminal voltage VG of the drive transistor M3 is quickly converged into the gate terminal voltage VG (N) decided by the current IREF and the characteristic of the drive transistor M of the (N)th row. Consequently, by the time t2 when changed to P3=L, the current writing operation is definitely completed. The period up to the time t1 to t2 corresponds to a first period T11.

The gage terminal voltage VG (N) is expressed by the following formula (2).

$$VG(N)=Vth(N)+(IREF/\beta(N))^{0.5} \quad (2)$$

Vth (N): a threshold value of the drive transistor M3 of the (N)th row

β(N): a drive coefficient of the drive transistor M3 of the (N)th row

Next, at the time t2, the scanning signal of the scanning line P3 changes to P3=L level, and the transistor M2 is turned off, and this allows a connection with the drain terminal of the transistor M3 and the signal line "data" to be broken. At this time, as shown in FIG. 3, as the current "Idata" of the signal line "data", a current IS (N) (second current) in the direction reverse to the current IREF is supplied to the signal line "data". Hence, the gate terminal voltage VG(N) of the drive transistor M3 of the (N)th row starts rising, and until the time t3 when changing to P1=H and P2=L shown in FIG. 2, this voltage rise is continued. The period up to this time t2 to t3 corresponds to a second period T12.

The reason why the voltage rise up to the time t2 to t3 is linear is because a gate load of the drive transistor M3 of the (N)th row is a capacitive load CL as shown in the following formula (3).

$$CL=Cs+Cg \quad (3)$$

Cs: the parasitic capacitance accompanying the signal line "data" of each column Cg: a sum of the holding capacitance C1 and the gate capacitance of the drive transistor M3

Further, the voltage rise ?V(N) in the gate terminal voltage VG(N) of the drive transistor M3 of the (N)th row is shown in the following formula (4).

$$\Delta V(N)=IS(N)\times(t3-t2)/CL \quad (4)$$

Next, at the time t3, each scanning signal of the scanning lines P1 and P2 changes to P1=L and P2=H, and the transistor M1 is turned off, and the transistor M4 is turned on, and the current writing operation of the (N)th row is terminated. At this time, the drain terminal of the drive transistor M3 is connected to the anode terminal of the display element, and moves to a lighting period (non-selection period T2).

By so doing, the drive transistor M3 of the (N)th row has the gate terminal isolated from the signal line "data" through the transistor M1, and is put into an open state. As a result, at the current writing operation time, the voltage between both terminals charged to the capacitive element C1 between the gate and source terminals becomes the gate terminal voltage VG (N) of the transistor M3 as it is.

At this time, the drive current (drain current) Id(N) between the source and drain terminals of the drive transistor M3 of the (N)th row is shown by the following formula (5) using the formulas (2) and (4).

$$Id(N)=\beta(N)\times[VG(N)-\Delta V(N)-Vth(N)]=\beta(N)\times[\{IREF/\beta(N)\}^{0.5}-IS(N)\times(t3-t2)/CL]^2 \quad (5)$$

As evident from the formula (5), the drive current Id (N) does not depend on the threshold value voltage Vth, and can be controlled by the current IS(N).

In the driving method illustrated in FIG. 3, in the pixel of the (N)th row, the drive voltage corresponding to intermediate brightness is generated, and therefore, the current IS(N) is a current of the middle-level. Further, in the pixel of the (N+1) th row, the drive current corresponding to low brightness is generated, and therefore, the current IS(N+1) is a current of the large level. Furthermore, in the pixel of the (N+2)th row, the drive current corresponding to high brightness is generated, and therefore, the current IS(N+2) is a current zero.

That is, the current IS may be turned into a signal current for controlling the display image. In the example of FIG. 3, for ease of description, while the current IS(N+2) when corresponding to the high brightness display is made to be a current zero, it is not limited to this. For example, when the setting of the current IREF is changed, the current IS (N+2) becomes the current IS (N+2) of the positive or the negative direction in FIG. 3. Here, the current IS (N+2) when corresponding to the high brightness is taken as the current IS (N+2) of the positive or the negative direction, the current IREF is set [larger] or [smaller] than the drive current Id (N+2) at each high brightness time.

Further, a current range of the drive current Id can be easily set by the constant current (first current)IREF and the constant period (t3–t2) (second period T12) by taking into consideration the parasitic capacitance Cs accompanying the signal line "data".

Further, as evident from the formula (5), though the drive current Id is not affected by the variations of the threshold value voltage Vth of the drive transistor M3, but is affected by the variations of the drive coefficient β of the drive transistor M3. However, since the current IS is small in a large drive current (high brightness) where the current absolute error becomes large, the drive current Id is hardly affected by the drive coefficient β. Further, though the drive current Id relates to the drive coefficient β in the small drive current where the current absolute error becomes small, since the absolute value error of the drive current can be small, the influence to the display image quality is small. When the current IREF is set [smaller] than the drive current Id(N+2) at the high brightness time, in a wide range of the drive current Id, the influence of the variations of the drive coefficient β can be made further small.

Although the drive current Id relates to the signal line parasitic capacitance Cs, since the signal line parasitic capacitance Cs is a total sum of the parasitic capacitance accompanying the signal line "data" in the pixel circuit 1 of each row, the deviation in proximity that influences the display image quality is extremely small. Even when there is the variation of the signal line parasitic capacitance, the spatial frequency in the column direction is low, and therefore, there is no great influence exerted on the display image quality.

As described above, in the present embodiment, since the writing operation ability of the pixel circuit 1 has nothing to do with the current value of the signal current IS, basically there is no problem of the writing operation ability in the current writing type pixel circuit shown in the formula (1).

The signal current IS has to be generated by a line sequential current, and can be generated also by an external IC. However, because of miniaturization and low-cost requirement, it is desirably formed by the TFT circuit on a glass substrate. The method of generating a stabilized line sequential signal current by the TFT circuit is disclosed in U.S. Patent Application Publication No. 2004/0183752. The generation of the constant current IREF is disclosed in Japanese Patent Application Laid-Open No. 2005-157322.

An outline of the operation of the present embodiment as described above is as follows.

1) During the first period T11 of the selection period T1, the drain terminal of the drive transistor M3 is connected to one terminal of the holding capacitance C1. In this state, both terminals of the holding capacitance C1 are connected between the emission power line PVdd and the signal line "data", and from the signal line "data", the constant current (first current) IREF capable of conducting the drive transistor M3 is supplied. As a result, the capacitive element C1 is charged.

2) During the second period T12 of the selection period T1, in a state in which the drain terminal of the drive transistor M3 is opened, the signal current (second current) IS corresponding to the injection current from the signal line "data" to the display element is supplied for a predetermined time. As a result, the voltage between both terminals of the capacitive element C1 is established.

3) After the termination of the period T12 of the selection period T1, during the lighting period T2, the holding capacitance C1 and the signal line "data" are isolated, and the source and drain terminals of the drive transistor M3 and two terminals of the display element are connected in series between the emission power line PVdd and the grounding line CGND. As a result, the drive current Id corresponding to the established voltage between both terminals of the capacitive element C1 is supplied to the display element.

As described above, in the EL panel of the present embodiment, in each pixel circuit 1, only for the period from the start of the writing period T1 to the first period T11, the constant current IREF is supplied to the signal line "Data" so as to perform the current writing. In the second period T12 after the elapse of the first period T11, a connection with the main conductive terminal (drain terminal) of the current drive transistor M3 and the signal line "Data" in each pixel circuit 1 is broken. Further, the signal current IS corresponding to the desired drive current is supplied to the signal line "Data", and at the same time, after the elapse of the second period T12, and the period moves to the lighting period T2 in which any of the main conductive terminals of the drive transistor M3 is connected to the display element.

Consequently, according to the present embodiment, by a simple change for the current writing type pixel circuit, a voltage writing type pixel circuit that substantially suppresses an variations of the threshold value voltage of the drive transistor of the pixel circuit can be realized, so that the display image quality of the EL panel can be greatly improved. Further, since the pixel circuit can perform the threshold value voltage detection operation of the drive transistor at a high current level, even in the limited writing period, the threshold value voltage detection operation can be reliably performed.

[Second Embodiment]

Figure 4:
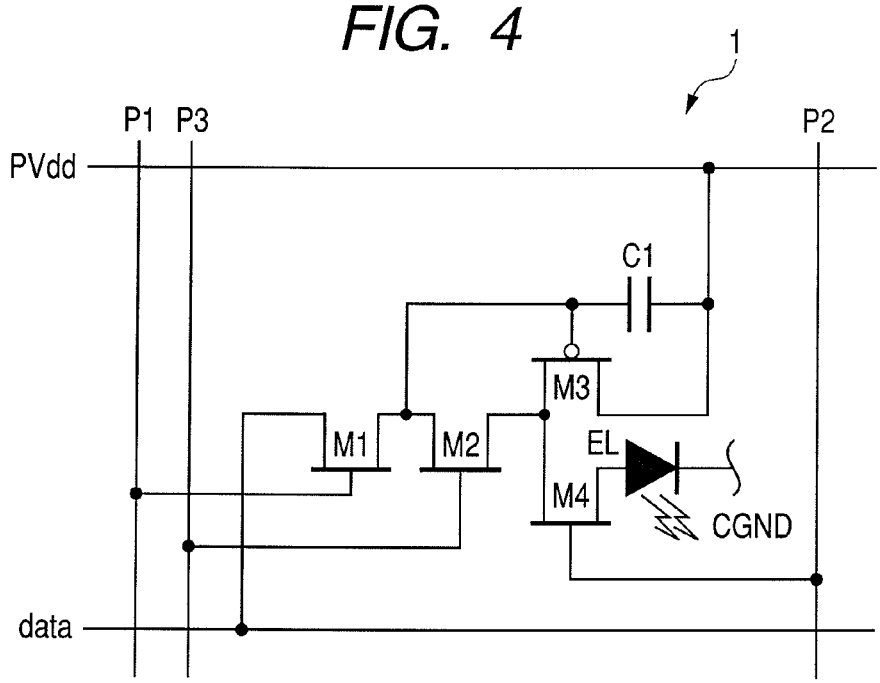
FIG. 4 is a circuit diagram showing a configuration of a pixel circuit of an EL panel according to a second embodiment of the present invention.

Next, a second embodiment of the present invention will be described with reference to FIG. 4.

Figure 9:
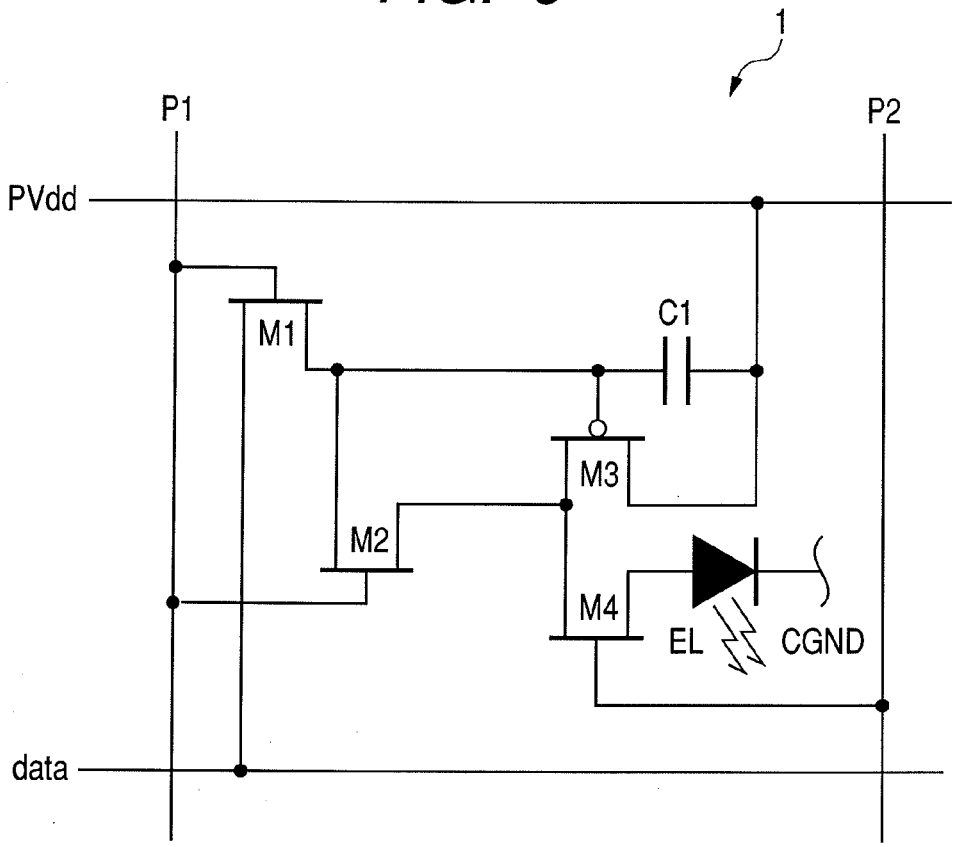
(PRIOR ART) FIG. 9
FIG. 9 is a circuit diagram showing the configuration of a conventional current writing type pixel circuit.

While the first embodiment applies the pixel circuit of FIG. 10, the present embodiment applies the pixel circuit of FIG. 9. That is, in the present embodiment, a transistor M2 is connected to a signal line "Data" through a transistor M1. Other configurations are the same as those of the first embodiment. A pixel circuit 1 of the present embodiment shown in FIG. 4 can perform the same operation as the pixel circuit 1 of FIG. 1 using each scan signal of scan lines P1, P2 and P3 shown in FIG. 2 and a current "Idata" of a signal line "data" shown in FIG. 3, and can achieve the same effect.

[Third Embodiment]

Next, the third embodiment of the present invention will be described with reference to FIGS. 5 to 7.

Figure 5:
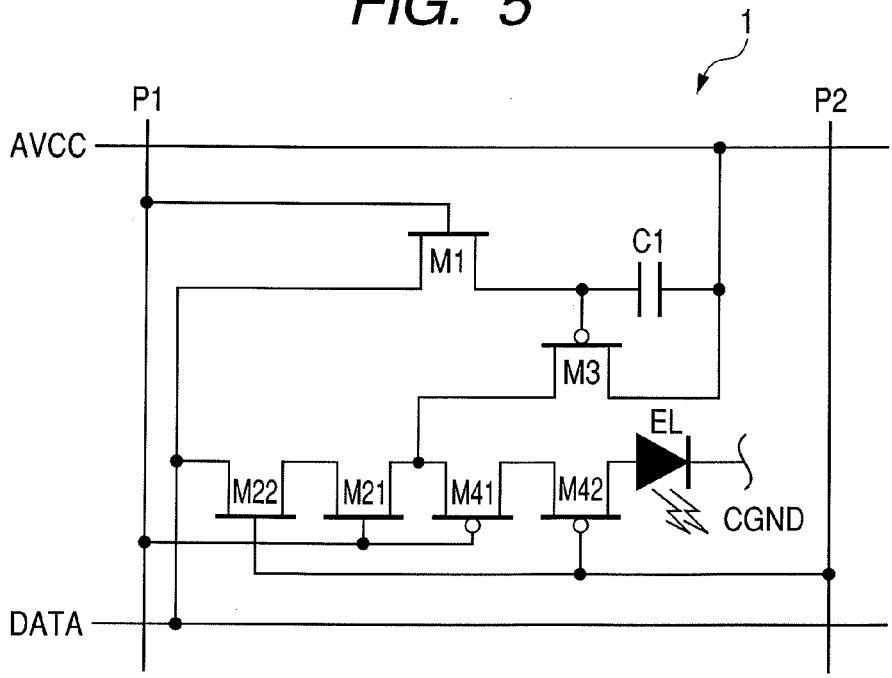
FIG. 5 is a circuit diagram showing a configuration of a pixel circuit of an EL panel according to a third embodiment of the present invention.

A pixel circuit 1 of the present embodiment shown in FIG. 5, when compared with the pixel circuit of FIG. 1, is different in that it has no scanning line P3, but has the scanning lines P1 and P2 only, and that transistors M2 and M4 are formed of two transistors M21 and M22, and two transistors M41 and M42, respectively. In the present embodiment, the transistor M21 and M22 include an n-type TFT, and the transistors M41 and M42 include a P-type TFT. The transistor M21 and M41 and the transistor M22 and M42 are controlled by each scanning signal of the scanning lines P1 and P2, respectively. Other configurations are the same as those of the first embodiment.

Figure 6:
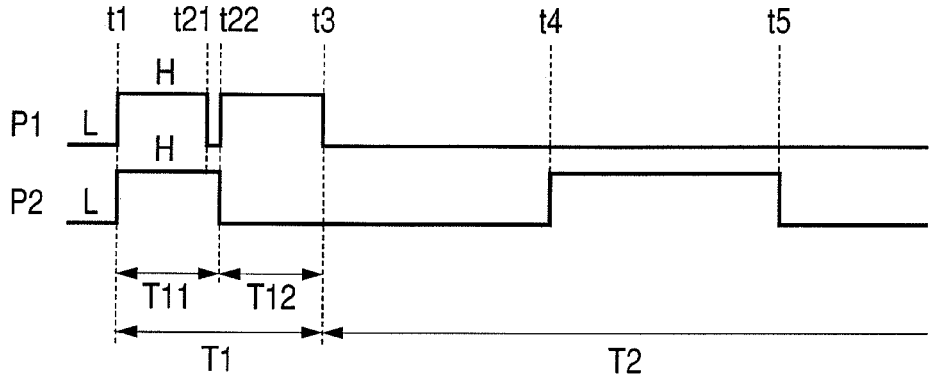
FIG. 6 is a time chart for describing the operation of the third embodiment.
Figure 7:
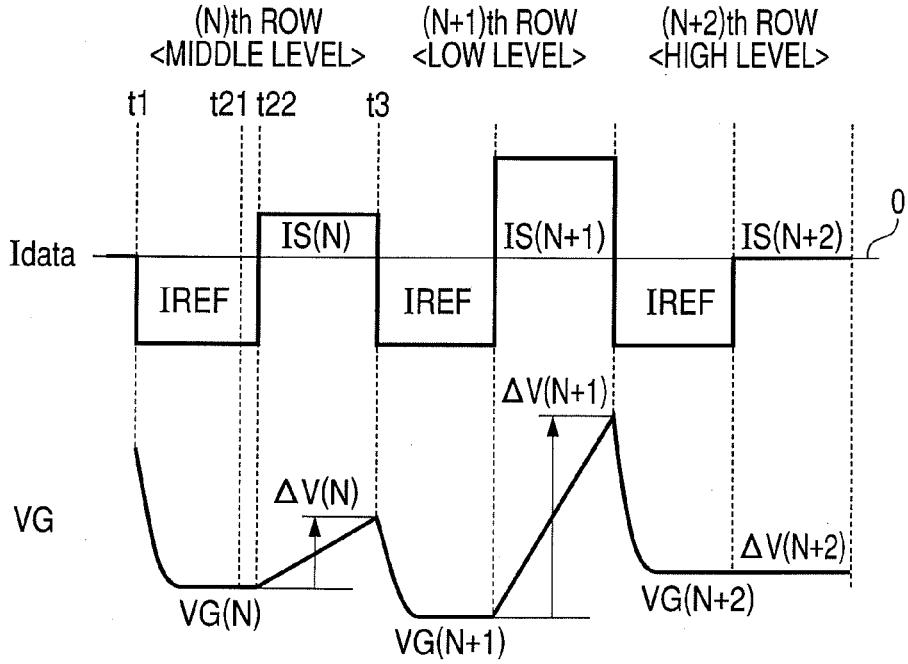
FIG. 7 is a time chart for describing the operation of the third embodiment similarly to FIG. 6.

The pixel circuit 1 of FIG. 5 can be operated by each scanning signal of the scanning lines P1 and P2 shown in FIG. 6 and the current "Idata" of a signal line "data" shown in FIG. 7. A difference between time charts of FIGS. 2 and 3 is that a timing t2 in which a current "Idata" of the signal line "data" changes from a current IREF to a current IS is switched by timings t21 and t22.

That is, as shown in FIG. 6, in the predetermined period (t21 to t22) before transiting from the period T1 to the lighting period T2, the scanning signal of the scanning line P1 becomes P1=L level, and the transistor M1 is turned off. As a result, in the time t21 before the current switching for the current "Idata" of the signal line "data", the connection with the gate terminal of the drive transistor M3 and the signal line "data" is broken. At the time t22, the scanning signal of the scanning line P2 becomes P2=L level, and after that, the scanning signal of the scanning line P1 is made to P1=H level, and the transistor M1 is turned on. As a result, the writing of an abnormal current to the capacitive element C1 at the current switching transition time can be definitely prevented, and therefore, a pixel writing operation can be certainly realized.

Further, in the configuration of FIG. 5, the number of scanning lines that is problematic than the number of TFTs can be made to be two lines similarly to the conventional current writing type pixel circuit as a constraint condition for disposing the pixel circuit in a pixel region. This is an important condition when the EL panel is made high-definition.

Further, as shown in FIG. 6, during the predetermined period (time t4 to t5) within the lighting period T2 (within non-selection period), the scanning signal of the scanning line P2 becomes P2=H level, and the connection with the drain terminal of the drive transistor M3 and the display element is broken. As a result, lighting-off control can be also performed, and therefore, by setting the lighting period, the brightness setting can be also easily performed.

In each of the above described embodiments, while the drive transistor includes the p-type TFT, and the switching transistors M1, M2 and M4 include the n-type TFT, the present invention is not limited to this. The TFT to be used can adapt any of the n-type or the p-type. An active layer of the TFT may be composed by using amorphous silicon or may include a material consisting essentially of silicon or a material consisting essentially of a metal oxide or a material consisting essentially of an organic matter.

Further, as an application, electronic apparatus such as a television receiver and a portable apparatus using the EL panel for the display apparatus can be set up.

The present invention can be adapted to the EL panel and the pixel circuit used for the panel and the application of the driving method thereof.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-174121, filed Jul. 2, 2007, which is hereby incorporated by reference herein in its entirety.

What is claimed is:

1. An active matrix type display apparatus configured by disposing a pixel circuit for supplying a current to a display element disposed at a position where a signal line and a scanning line intersect the pixel circuit, comprising:

a drive transistor having a first main conductive terminal connected to a constant voltage source, a second main conductive terminal for injecting the current to the display element, and a control terminal; and a capacitive element connected between the control terminal of the drive transistor and the first main conductive terminal, the pixel circuit being connected to the signal line during a selection period, and isolated from the signal line during a non-selection period, wherein the selection period includes a first period and a second period, and during the first period, the second main conductive terminal of the drive transistor and the display element are isolated, the control terminal and the second main conductive terminal of the drive transistor are connected to the signal line, and the signal line is supplied with a first current capable of conducting the drive transistor, with the first current not corresponding to a signal current corresponding to the current injected to the display element, during the second period, the second main conductive terminal of the drive transistor is disconnected from the signal line, and the signal line is supplied with a second current corresponding to a signal current for controlling a display image, in a direction reverse to the first current, and during the non-selection period, the second main conductive terminal of the drive transistor and the display element are connected, and a drive current according to the voltage between both terminals of the capacitive element is supplied from the drive transistor to the display element.

2. The active matrix type display apparatus according to claim 1, wherein, after the first period and before the second period, the control terminal of the drive transistor is disconnected from the signal line.

3. The active matrix type display apparatus according to claim 1, wherein a connection with the second main conductive terminal of the drive transistor and the display element is broken within the non-selection period, so that the display element is turned off.

4. The active matrix type display apparatus according to claim 1, wherein the pixel circuit further includes a first switch, a second switch and a third switch including transistors whose on-and-off operations are controlled by the control signal of the scanning line, and the first switch is disposed between the control terminal of the drive transistor and the signal line, the second switch is disposed between the second main conductive terminal of the drive transistor and the signal line, and the third switch is disposed between the second main conductive terminal of the drive transistor and one terminal of the display element.

5. The active matrix type display apparatus according to claim 4, wherein the scanning line comprises a first scanning line, a second scanning line and a third scanning line, the first scanning line is connected to a control terminal of the first switch, the second scanning line is connected to a control terminal of the second switch, and the third scanning line is connected to a control terminal of the third switch.

6. The active matrix type display apparatus according to claim 4, wherein any of the drive transistor, the first switch, the second switch and the third switch includes a TFT.

7. The active matrix type display apparatus according to claim 6, wherein the drive transistor includes a p-type TFT, and any of the first switch, second switch and third switch includes an n-type TFT.

8. A driving method of an active matrix type display apparatus disposed with a pixel circuit to which a signal line and a scanning line are connected for supplying a current to a display element two dimensionally arranged, with the pixel circuit comprising a drive transistor having a first main conductive terminal connected to a constant voltage source, a second main conductive terminal for injecting the current to the display element, and a control terminal, and a capacitive element connected between the control terminal of the drive transistor and the first main conductive terminal, the pixel circuit being connected to the signal line during a selection period and isolated from the signal line during a non-selection period, wherein the selection period includes a first period and a second period, the driving method comprising:

during the first period, the second main conductive terminal of the drive transistor and the display element are isolated, the control terminal and the second main conductive terminal of the drive transistor are connected to the signal line, the step of supplying the signal line with a first current capable of conducting the drive transistor, with the first current not corresponding to a signal current corresponding to the current injected to the display element;

during the second period, the second main conductive terminal of the drive transistor is disconnected from the signal line, the step of supplying the signal line with a second current corresponding to a signal current for controlling a display image, in a direction reverse to the first current; and during the non-selection period, the second main conductive terminal of the drive transistor and the display element are connected, the step of supplying a drive current according to the voltage between both terminals of the capacitive element from the drive transistor to the display element.

* * * * *